United States Patent [19]

Logsdon

[11] Patent Number: 4,487,690

[45] Date of Patent: Dec. 11, 1984

[54] SUMP OR FLUSH INSTALLABLE ROOF DRAIN

[76] Inventor: Duane D. Logsdon, 1708 Calavera Dr., Fullerton, Calif. 92631

[21] Appl. No.: 476,985

[22] Filed: Mar. 21, 1983

[51] Int. Cl.[3] ..... E03F 5/14; E03F 5/06

[52] U.S. Cl. ..... 210/163; 405/36; 405/127

[58] Field of Search ..... 405/303, 36, 37, 127, 405/38, 118–126; 210/163, 164, 166

[56] References Cited

U.S. PATENT DOCUMENTS

| | | | |
|---|---|---|---|
| 2,079,269 | 5/1937 | Williams | 210/163 X |
| 2,283,160 | 5/1942 | Boosey | 210/163 |
| 3,884,809 | 5/1975 | Logsdon | 210/163 |
| 4,035,297 | 7/1977 | Aldridge et al. | 210/163 |

*Primary Examiner*—Dennis L. Taylor

*Attorney, Agent, or Firm*—K. H. Boswell; Edward D. O'Brian

[57] ABSTRACT

A roof drain for either a sump or a flush installation has a body having a centrally located water collecting section which is capable of being attached to a pipe, a first surface extending around the periphery of the central section, a connecting surface extending upwardly and away from the periphery of the first surface and a second surface extending outwardly around the periphery of the connecting surface. The first and second surfaces are parallel to one another with the second surface serving as the mounting surface for mounting the drain on to a roof. A grate attaches to the body by attaching directly to the second surface for sump functioning, or in conjunction with an insert for flush functioning. For the flush functioning, the insert fits against the connecting surface and the first surface to become located between the grate and the body.

6 Claims, 4 Drawing Figures

2
2
64
48
44
54
46
52
50
38
32
36
30
42
74
40
34
10
76
70
24
14
16
12
62
56
28
26
18
20
68
66
72
22

SUMP OR FLUSH INSTALLABLE ROOF DRAIN

BACKGROUND OF THE INVENTION

This invention is directed to a roof drain which is capable of being oriented in either a sump or a flush orientation with respect to a roof. The roof drain includes a body and a grate attaching thereto with the grate fitting down into the body for the sump orientation, or in combination with an insert which fits into the body to which the grate attaches for the flush orientation.

Structures with flat roofs generally benefit by locating one or more drains on the flat roof to assist in water removal during rain, snow and the like. If these roof drains are incorporated during construction, their placement can be such with regard to number and location that water is removed from the roof concurrently with deposit thereon. Many times, however, buildings are constructed with flat roofs with no roof drains incorporated therein.

On those structures which have flat roofs, and no roof drains provided, ponding of water can occur on the roof with this ponding ultimately resulting in serious deterioration of the roof in those areas wherein the ponding occurs. Sunlight passing through the standing water in such a pond located on a roof tends to be reflected and/or refracted by the water such that deterioration of the roofing material in the ponding area occurs, resulting in leakage of the roof at this area. In roofs which have been subjected to prior ponding, it is advisable to attempt to prevent future ponding on the roof. As such, roof drains installed on these roofs should be capable of totally draining the roof to prevent further deterioration of the roofing material. In such instances, the roof drain should act as a sump capable of removing all standing water located in the area of the roof drain.

In other instances, it is desirable to govern the flow of water off a roof during a rain storm or the like. In these instances, a roof drain which lies flush with the surface of the roof and utilizes a grate having weirs to accommodate different flow rates of water through the grate depending upon the height of the water standing against the grate might be the roof drain of choice.

Further, during new construction, it is highly desirable to have the roofing material as continuous as possible into the grate area of the roof drain. Roof drains which make no provision for having roofing material laid over their surfaces, except for the drain areas, do not allow this type of construction. By incorporating the roofing material as close as possible to the grate structure the integrity of the roof is insured over a long service life.

With regard to the above described problems, a product could be customized for each and every one of the desired applications. The production, however, of many individual, customized products leads to escalating costs of the products. Whether or not these products are formed from metal or plastic, dies and/or molds must be used to manufacture the product. Since these individual dies and molds can be quite expensive, depending upon the size and complexity of the mold or die, the ultimate price the consumer must pay for the item is related to the number of items certain fixed costs can be spread over. The production of many different types of drain systems customized to an individual utility thus leads to increased cost of these individual units.

Additionally, storage and costs of a large inventory of many individual custom units leads to expense to the wholesaler, retailer and the like, which ultimately is also passed on the the consumer. Further, because normally skilled labor is utilized in installing roof drains and the like, optimization of installation and operation is desirable in order to further lead to a more economical product for the consumer.

BRIEF DESCRIPTION OF THE INVENTION

In view of the above, it is evident that there exists a need for a roof drain structure which is capable of being utilized for many different applications in place of a multiple of individual structures previously used for these same applications. There is a further need for such a roof drain structure which, becuse of its engineering and construction, is economically manufactured, conveniently stored in minimum space and easily and rapidly installed upon a structure. It is a broad object of this invention to fulfill the needs described in the previous two sentences. It is a further object of this invention to provide a roof drain structure which is durable in handling both prior to, during installation of, and during the service life upon a structure. Additionally, it is an object of this invention to provide a structure which can be intimately mated with a roof either during construction or in a repair situation in order to provide a water tight seal with the roof, insuring that installation of the drain structure does not, itself, lead to leakage of the roof.

These and other objects, as will become evident from the remainder of this specification, are achieved in a roof drain which comprises: an integrally formed body having a water collecting section, a first body surface, a second body surface and a connecting surface; said water collecting section centrally located within said body, said collecting section including a generally funnel shaped portion with said funnel shaped portion terminating into a vertically oriented cylindrical section, said cylindrical section forming the lowermost portion of said body with said cylindrical section sized and shaped for joining to a cylindrical pipe; said first body surface being generally horizontally oriented and extending outwardly and completely surrounding said collecting section; said second body surface being generally horizontally oriented and positioned upwardly and outwardly from said first body surface and completely surounding said first body surface with said connecting surface joining said second body surface to said first body surface, said second body surface being parallel to said first body surface; a self-supporting grate member having a peripheral mounting flange and a central foraminous structure completely surrounded by said mounting flange and extending upward from said mounting flange, said foraminous structure serving as a water passageway from the exterior of said grate to the interior of said grate; said peripheral mounting flange including at least two vertically oriented connecting openings; said first body surface including a plurality of vertically oriented open mouth closed end tube means, said tube means located in said first body surface with said open mouths projecting upwardly and said closed ends located below said open mouths, said tube means positioned on said first body surface such that at least two of said plurality of tube means are located in a vertical alignment with said openings in said peripheral flange of said grate means when said grate means is positioned above said body; a plurality of connecting members equal in number to the number of said openings in said peripheral flange of said grate means, said connecting members capable of connecting said grate means to said body by passing through said openings in said peripheral flange of said grate means and into and connecting with said tube means in said first body surface of said body; said second body surface of said body capable of being located on and attached to a roof.

Preferredly, the connecting surface would be obliquely oriented with respect to the parallel first and second surfaces and extending outwardly and upwardly from the first surface to the second surface. When utilized as a sump, the grate means would then fit into the body and rest upon the first surface with the obliquely oriented connecting surface serving to channel water from the second surface into the grate means.

For use with the grate flushly oriented with respect to the second surface, an insert means would be included with the insert means sized and shaped to overlay the first surface and the connecting surface. The insert means would be connectable to the body in connection with connecting the grate means to the body or, additionally, it could be independently connected to the body, utilizing tube means located in the body with the insert means being attached to these tube means by other connecting members.

Preferredly, the insert means would have a first and second surface which are horizontally oriented and are parallel with respect to one another with the first of these surfaces surrounding a centrally located opening in the insert means and the second of the surfaces located outwardly and upwardly from the first surface. When the insert means is mounted to the body, the second surface of the insert means would essentially lie in the same plane as the second surface of the body. The mounting flanges of the grate means would be capable of being located against the first surface of the insert means.

In the illustrative embodiment of this invention, the outermost periphery of the first surface of the body, the outermost periphery of the connecting surface of the body and the insert means are rectangular in shape. Further, the first surface of the insert means would also be rectangular in shape such that it could accept a rectangular shaped outermost periphery of the mounting flange at the grate means.

BRIEF DESCRIPTION OF THE DRAWINGS

This invention will be better understood when taken in conjunction with the drawings wherein.

Figure 1:
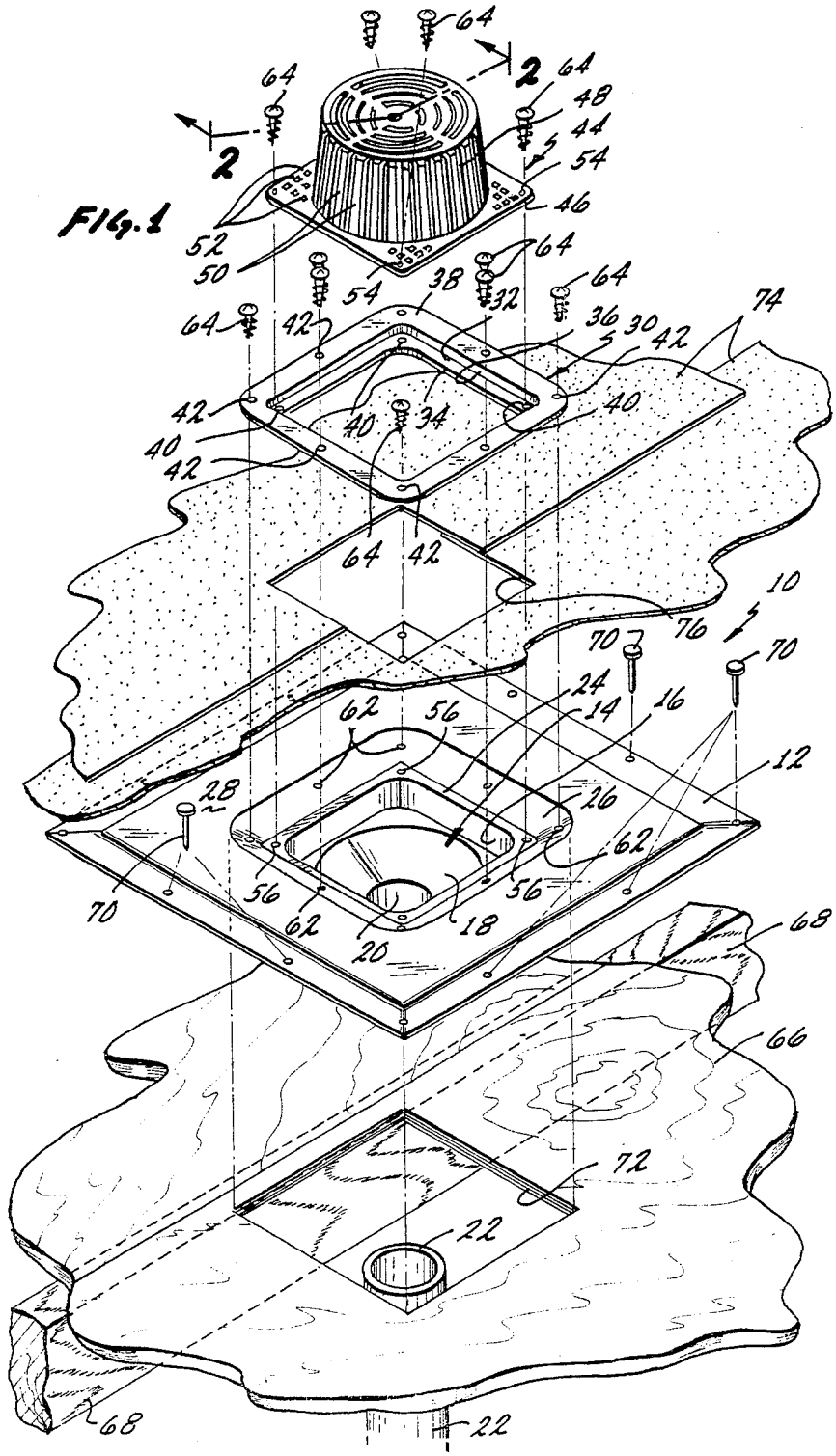
FIG. 1 is an exploded isometric view, partially cut away, showing use of this invention on a typical roof surface.

The invention described in this specification and illustrated in the drawings utilizes certain principles and/or concepts as are set forth in the claims appended to this specification. Those skilled in the plumbing arts will realize that these principles and/or concepts are capable of being utilized in a variety of embodiments differing from the illustrative embodiment herein. For this reason, this invention is not to be construed as being limited to the illustrative embodiment, but is only to be construed as being limited by the claims.

DETAILED DESCRIPTION OF THE INVENTION

Figures 2, 3, 4:
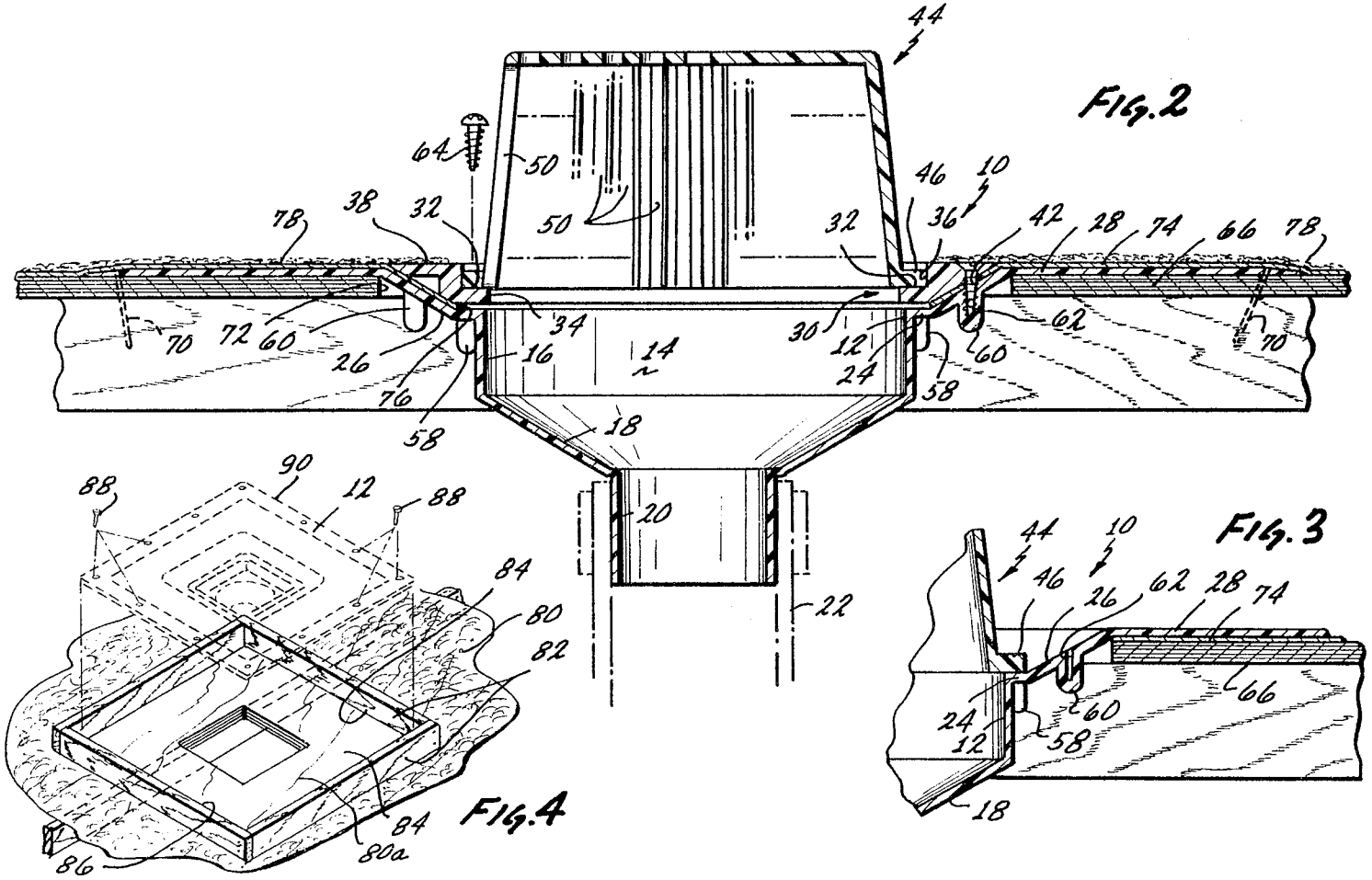
FIG. 2 is a side elevational view in section about the line 2—2 of FIG. 1.
FIG. 3 is a side elevational view in partial section similar to FIG. 2 except that one of the components shown in FIG. 2 is not utilized in the orientation shown in FIG. 3.
FIG. 4 is an exploded isometric view showing one method of attachment of one of the components of the invention.

In reference now to FIGS. 1, 2 and 3, the illustrative embodiment of the invention is shown in relationship to a roof of a structure. Prior to discussing attachment of the illustrative embodiment to such a roof as shown, the component parts of the embodiment will be described. These component parts are arranged in a first orientation in FIGS. 1 and 2, and then in an alternate orientation in FIG. 3, wherein the alternate orientation of FIG. 3 differs from that of FIGS. 1 and 2 in that one of the components shown in FIGS. 1 and 2 is not utilized in this alternate configuration.

In FIG. 1, the roof drain 10 utilizes a body 12 which has several component portions or sections. The first of these is central section 14 which is located directly in the middle of the body 12. Section 14 is composed of a vertical wall 16 attaching to a funnel shaped sloping wall 18 which culminates in a vertically oriented cylindrical wall 20. The cylindrical wall 20 is sized and shaped such that a pipe, such as pipe 22, can mate with the cylindrical wall 20 in order that water collected by the central section 14 can be discharged into the pipe 22.

Extending completely around the periphery of the central section 14 is a first surface 24. The first surface 24 is horizontally oriented and in the preferred embodiment shown is quadrilaterally shaped. The periphery of the first surface is completely surrounded by connecting surface 26. The connecting surface slopes upwardly and outwardly completely around the first surface 24, then merges with a second surface 28. The connecting surface 26 and the second surface 28 are also preferredly quadrilaterally shaped. The totality of the body 12 including the central section 14 and its component parts, the first surface 24, the connecting surface 26 and the second surface 28, are all formed as an integrally formed, unified body. They would be preferredly formed of a suitable plastic material such as ABS plastic or the like, incorporating suitable UV protective agents as are commonly employed in the plumbing industry for the formation of plastic parts and the like.

An insert member 30 is sized and shaped such that it can fit into the area directly above the first surface against the first surface 24 and the connecting surface 26. The insert member 30 includes a first insert surface 32 located around a central square opening 34 which serves as a water passageway through the insert member 30. A vertical wall 36 connects the first insert surface 32 with a second insert surface 38. The first and second insert surfaces 32 and 38 are parallel with one another with the second insert surface 38 being disposed upwardly and outwardly from the first insert surface 32.

The insert member 30 includes holes located at the four respective corners of the first insert surface 32. These holes are collectively indentified by the numeral 40 in the drawings. Additionally, the insert member 30 includes the holes collectively identified by the numeral 42 spaced at the corners of and in the center of each of the second insert surfaces 38. The holes 40 and 42 pass completely through the body of the insert member 30 and are utilized as described below.

A grate member, such as grate member 44, completes the three major components of the roof drain 10. The illustrated grate member 44 contains a peripheral flange 46 and an upstanding, self-supporting drain structure 48. The drain structure 48 includes a plurality of openings 50, allowing for water to pass from the exterior of the drain member 44 to its interior. Further, openings 52 can be formed in the flange 46 of the grate member 44.

The grate member 44 described above would be the grate member of choice for use in a sump orientation of the roof drain 10, as hereinafter described. For use in a flush orientation of the roof drain 10, a grate member other than the grate member 44 could be substituted. As for example, the grate members described in my application Ser. No. 271,501, filed June 8, 1981, entitled, "Drain Structure With Adjustable Weirs", the entire disclosure of which is herein incorporated by reference, could be utilized. In such a drain structure as described in my application Ser. No. 271,501, a variability of flow from the exterior of the grates described therein to the interior of the grate, depending upon the height of the standing water against the exterior surface of the grate, can be achieved. In those instances, as hereinafter described, using the flush orientation of the roof drain 10 of this invention, wherein regulation of the discharge of water from the roof is sought, such a grate member as described in application Ser. No. 271,501 would be the grate of choice to achieve this regulation of the water flow. Thus, for instance, in order not to overload the drainage system of municipal sewers and the like during an extremely heavy rainfall, a grate member which allows for regulation of this water flow would be desirable. In any event, in the flush orientation of the roof drain 10 of my invention, as shown in FIG. 2, substitution of the grate member 44 depicted therein might be desirable in order to achieve different flow characteristics through the grate member utilized. In any event, any grate member utilized would include a flange such as the flange 46 of the grate member 44 illustrated and a drain structure as, for example, drain structure 48 which allows for passage from the exterior of the grate member to the interior of the grate member.

For the illustrative grate member 44, the peripheral flange 46 includes opening collectively identified by the numeral 54 located at the respective corners of the peripheral flange 46 which, as illustrated, is preferredly quadrilaterally shaped such that it meshes with the quadrilateral shape of both the insert member 30 and the cylindrical wall 20 and the first insert surface 24. The grate member 44 can be mounted to the body 12 by mounting it directly against the first body surface 24, as is shown in FIG. 3 in the sump orientation of the roof drain 10. Alternately, in the flush orientation of the roof drain 10, the insert member 30 would be interspaced between the grate member 44 and the body 12, with the peripheral flange 46 of the grate member 44 located on top of the first insert surface 32 with the insert member 30 apprpriately located on the body 12 against the first body surface 24 and the connecting surface 26.

Referring now to FIGS. 2 and 3, it can be seen that at the four corners of the first body surface 24 are mouths, collectively identified by the numeral 56, forming the uppermost extension of an opening, not separately identified or numbered, formed in a tube 58 formed as a part of the body 12 directly below the mouths 56. Each of the tubes 58 are closed at their lower end with a continuous cylindrical wall extending toward the body 12 with the mouths 56 formed as an upwardly projecting opening for the tubes 58. Likewise, similar tubes 60, having mouths 62 are formed in the connecting surface 26.

The tubes 58 with their mouths 56 are positioned in the first body surface 24 such that they line up with both the holes 40 in the corners of the first insert surface 32 of the insert member 30 as well as the holes 54 in the corners of the peripheral flange 46 of the grate member 44. The tubes 60 and mouths 62 are lined up such that they line up with the holes 38 in the second insert surface 38 of the insert member 30. Both the tubes 58 and 60 are vertically oriented such that appropriate connecting members such as screws, collectively identified by the numeral 64 can be threaded into the tubes 58 or 60, as is illustrated on the right hand side of FIG. 2.

In reference to FIG. 2, when the roof drain 10 is used in the flush orientation, the insert member 30 is attached to the body 12 by utilizing screws 64 passing through the holes 42 in the insert member 30 and into the tubes 60. The grate member 44 can then be attached to the body 12 with the insert member 30 located between it by passing other of the screws 64 through the holes 54 in the flange 46 of the grate 44, then through the holes 40 in the first insert surface 32 of the insert member 30 and finally screwing these connecting members 64 into the tubes 58. For the sump orientation seen in FIG. 3, the insert member 30 is not utilized and the grate member 44 is directly attached to the body 12 by passing appropriately sized screws 64 through the holes 52 and screwing them directly into the tubes 58. It is, of course, realized that when the insert member 30 is utilized, screws 64 of a slightly longer length will be necessary for the flush orientation than when insert member 30 is not utilized in the sump orientation.

Referring now to the exploded view shown in FIG. 1, the pipe 22 has previously been identified. The pipe 22 would be associated with a structure on which the roof drain 10 was to be attached. Shown as a portion of the structure would be sub-floor 66 and rafter 68. For new construction wherein the roof drain 10 is installed during construction of the building, normally the body 12 would be applied directly to the sub-floor 66 and fastened thereto with appropriate nails or the like, shown by the numeral 70. When so attached, the second surface 38 of the body 12 then lies on the sub-floor 66 with the first surface 24 of the body 12 parallel with the second surface 28, but spaced downwardly within an opening 72 cut into the sub-floor 66. Additionally, the central section 14 would, of course be disposed within the opening 72 and when the body 12 is mounted to the sub-floor 66 the cylindrical wall 20 of the central section 14 would be appropriately mounted to the pipe 22.

For attaching the cylindrical wall 20 to the pipe 22, a clamp, such as that utilized in my concurrently filed application entitled, "Pipe Positioning Clamp", U.S. Ser. No. 476,986, 3-21-83, would preferredly be used. This clamp allows for securing the pipe 22 against upward movement caused by thermal expansion of the pipe 22 such that upward movement of the pipe 22 is not transferred to the body 12 tending to urge the body 12 upward off of the sub-floor 66, destroying appropriate water seals and the like as hereinafter discussed.

In any event, during original construction, after application of the body 12 to the sub-floor 66 appropriate roofing material such as paper 74 or the like, can be overlayed over the body 12, as is seen in FIG. 2, with an opening 76 in the paper 74 to accommodate the depression in the body 12 formed by the connecting surface 26, the first body surface 24 and the central section 14. Preferredly, the edges of the paper 74 at the opening 76 would overlap against the sides of the connecting surface 26. This construction is as seen in FIG. 2.

Next, if a flush orientation of the grate member 44 is desired, the insert member 30 is utilized and is placed over the edges of the paper 74 at the opening 76 in the paper 74 such that the edges of the paper 74 at this opening 76 are positioned between the connecting surface 26 and the underside of the insert member 30. Next, the grate member 44 is placed on the insert member 30 such that the peripheral flange 46 of the grate member 44 fits against the first insert surface 32. Appropriate screws 64 or the like can now be utilized to attach the grate member 44 and the insert member 30 to the body 12. The top of the paper 74 can then be "hot mopped" with tar, as identified by numeral 78 in FIG. 2, right up to and over the second insert surface 38 of the insert member 30.

When in the flush orientation as seen in FIG. 2, any standing water on the roof of the structure so depicted will be channeled into the grate member 44, passed through the grate member 44 and be collected by the central section 14 before being passed to the pipe 22 for discharge.

In the sump orientation seen in FIG. 3, the body 12 and the grate member 44 are utilized without utilizing the insert member 30 between them. As such, this positions the peripheral flange 46 of the grate member 44 directly on the first body surface 24 of the body 12. The connecting surface 26 of the body 12 now forms a sloping wall to channel water to the grate member 44. Because the connecting surface 26 slopes downwardly and inwardly toward the center of the body 12, any and all water is channeled into the central section 14 at all times, to thoroughly drain the roof on which the roof drain 10 is mounted. This is most useful in those situations wherein a roof without a roof drain has developed a leak and it has been found necessary to incorporate a roof drain on this roof to prevent further deterioration of the roof. In reference now to FIG. 4, the manner wherein the roof drain 10 can be attached to a roof which is currently undergoing a leakage problem is depicted. In FIG. 4, the roof 80 is currently leaking, and is assumed to include standing water presently located thereon. The plumber in solving the leakage of the roof 80 builds a small dam out of two or fours, as depicted by the numeral 82. The interior of the dam 84 is then drained of water by bailing, sponging or the like, to expose the area of the roof, area 80*a*, within the dam 82, in a dry condition. A hole 86 is now cut into the roof 80 to accommodate the roof drain 10.

The dam 82 is sized such that the interior 84 is large enough to accommodate locating the body 12 within the confines of the dam 82. After the hole 86 is cut, the body 12 is then lowered into the interior of the dam 82 until the underneath surface of the second body surface 28 of the body 12 is located on top of the roof 80. The cylindrical wall 20 of the central section 14 is then appropriately mounted to a pipe which is plumbed within the interior of the structure which is leaking. Next the body 12 is fixedly attached to the roof 80, utilizing fastening means such as nails 88. After fastening the body 12 to the roof 80, the outside peripheral edge 90 of the body 12 is sealed to the roof 80 utilizing an appropriate sealing compound such as a hot mop tar or the like.

For leakage problems, the sump orientation depicted in FIG. 3 is the preferred orientation of the roof drain 10. Thus, to accommodate this, after the body 12 is appropriately sealed to the roof 80, a grate member 44 is attached to the body 12 to complete the installation. Withdrawal of the dam 82 allows the water located on the roof 80 to then flow to the sump created by the roof drain 10 presently positioned on the roof, allowing for removal of this water to cure the leakage problem.

As noted above, maintenance of the roof drain 10 to a leaky roof is facilitated utilizing the clamp of my concurrently filed application entitled, "Pipe Positioning Clamp", U.S. Ser. No. 476,986, 3-21-83. The combination of the roof drain 10 with this clamp in situations wherein the roof has actually leaked leads to a very stable structure alleviating continued leakage or pooling of water on such a roof.

I claim:

1. A roof drain which comprises:

an integrally formed body having a water collecting section, a first body surface, a second body surface and a connecting surface;

said water collecting section located within said body, said collecting section including a generally funnel shaped portion with said funnel shaped portion terminating into a vertically oriented cylindrical section, said cylindrical section forming the lowermost portion of said body with said cylindrical section sized and shaped for joining to a cylindrical pipe;

said first body surface being generally horizontally oriented and extending outwardly and completely surrounding said collecting section;

said second body surface being generally horizontally oriented and positioned outwardly and upwardly from said first body surface and completely surrounding said first body surface with said connecting surface joining said second body surface to said first body surface, said second body surface being parallel to said first body surface;

said connecting surface is obliquely oriented with respect to said parallel first and second body surface and extends outwardly from said first body surface to said second body surface;

a self supporting grate member having a peripheral mounting flange and a central foraminous structure completely surrounded by said mounting flange and extending upward from said mounting flange, said foraminous structure serving as a water passageway from the exterior of said grate to the interior of said grate;

said peripheral mounting flange including at least two vertically oriented connecting openings, said peripheral mounting flange sized and shaped so as to be capable of being located against and mating with said first body surface and when mated with said first body surface said peripheral mounting flange positioned inwardly and downwardly from said second body surface and inwardly from said connecting surface;

said first body surface including a plurality of vertically oriented open mouth closed end tube means, said tube means located in said first body surface with said open mouths projecting upwardly and said closed ends located below said open mouths, said tube means positioned on said first body surface such that at least two of said plurality of tube means are located in a vertical alignment with said openings in said peripheral flange of said grate means when said grate means is positioned above said body;

a plurality of connecting member equal in number to the number of said openings in said peripheral flange of said grate means, said connecting members capable of connecting said grate means to said body by passing through said openings in said peripheral flange of said grate means and into and connecting with said tube means in said first body surface of said body.

2. The roof drain of claim 1 including:

an insert means sized and shaped to overlay said first body surface and said connecting surface, said insert means having a centrally located opening forming a passageway through said insert means;

said insert means including a plurality of vertically connecting openings spaced outwardly from said central opening, said insert means capable of being located in said body fitting over said first body surface and said connecting surface and when so located said connecting openings in said insert means being located in a vertical alignment with said tube means;

said grate means capable of being located on said body and when so located on said insert means said connecting openings in said peripheral mounting flange of said grate means being in a vertical alignment with at least two of said connecting openings located in said insert means and said tube means with which they are associated;

said connecting members capable of passing through both said connecting openings in said grate means and said insert means prior to connecting to said tube means;

said centrally located openings in said insert means forming a water passageway from the interior of said grate means to said water collecting section of said body;

said insert means having first and second insert surfaces both of which are horizontally oriented and are parallel to one another, said first insert surface surrounding said centrally located openings in said insert means and said second insert surface located outwardly and upwardly from said first insert surface;

said second insert surface lying in essentially the same plane as said second body surface when said insert means is located in said body;

said peripheral mounting flange of said grate means capable of being located against said first insert surface when said grate means and said insert means are located in a vertical stack on said body.

3. The roof drain of claim 2 wherein:

the outermost periphery of said first body surface is quadrilateral in shape;

the outermost periphery of said connecting surface is quadrilateral in shape; and said insert means is quadrilateral in shape.

4. The roof drain of claim 3 wherein:

said first insert surface is quadrilateral in shape;

the outermost periphery of said mounting flange of said grate means is quadrilateral in shape.

5. The roof drain of claim 2 wherein:

when said insert means is interspaced between said grate means and said body said mounting flange of said grate means lies in essentially the same horizontal plane as said second surface of said body.

6. The roof drain of claim 1 wherein:

when said grate means is located on said body said mounting flange of said grate means lies in a horizontal plane which is depressed with respect to a horizontal plane in which said second surface of said body lies and said obliquely oriented connecting surface conducts water from said second surface of said body to said grate.

* * * * *